US011417976B2

(12) United States Patent
Huang et al.

(10) Patent No.: US 11,417,976 B2
(45) **Date of Patent: *Aug. 16, 2022**

(54) ELECTRICAL CONNECTOR

(71) Applicant: Tyco Electronics (Shanghai) Co. Ltd., Shanghai (CN)

(72) Inventors: Liang Huang, Chengdu (CN); Wei Peng, Middletown, PA (US); Hongtao Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 136 days.

This patent is subject to a terminal disclaimer.

(21) Appl. No.: 16/744,554

(22) Filed: Jan. 16, 2020

(65) Prior Publication Data

US 2020/0235507 A1 Jul. 23, 2020

(30) Foreign Application Priority Data

Jan. 17, 2019 (CN) ..... 201910046291.0

(51) Int. Cl.
*H01R 12/72* (2011.01)
*H01R 13/6471* (2011.01)
*C22C 38/18* (2006.01)

(52) U.S. Cl.
CPC ..... *H01R 12/727* (2013.01); *C22C 38/18* (2013.01); *H01R 13/6471* (2013.01)

(58) Field of Classification Search
CPC .... H01R 13/24; H01R 13/20; H01R 13/1316; H01R 13/516; H01R 13/53; H01R 13/6315; H01R 13/6582; H01R 12/55; H01R 43/26; H01R 13/03; B61G 5/06
See application file for complete search history.

(56) References Cited

U.S. PATENT DOCUMENTS

| | | | | |
|---|---|---|---|---|
| 5,277,592 A * | 1/1994 | Morlion | H01R 12/737 439/65 |
| 5,904,581 A * | 5/1999 | Pope | H01R 24/60 439/74 |
| 10,050,386 B1 * | 8/2018 | Pickel | H01R 13/6473 |
| 10,615,531 B2 * | 4/2020 | Hayama | H01R 24/78 |
| 2019/0044285 A1 * | 2/2019 | Dunham | H01R 13/514 |

* cited by examiner

*Primary Examiner* — Briggitte R. Hammond
(74) *Attorney, Agent, or Firm* — Barley Snyder

(57) ABSTRACT

An electrical connector includes a connector housing and a plurality of conductive terminals mounted in the connector housing. The plurality of conductive terminals include a plurality of ground terminals and a plurality of signal terminals. The ground terminals and the signal terminals are each made of a lossy metal. A surface of each of the signal terminals is coated with a low lossy metal.

20 Claims, 16 Drawing Sheets

ELECTRICAL CONNECTOR

CROSS-REFERENCE TO RELATED APPLICATION

This application claims the benefit of the filing date under 35 U.S.C. § 119(a)-(d) of Chinese Patent Application No. 201910046291.0, filed on Jan. 17, 2019.

FIELD OF THE INVENTION

The present invention relates to an electrical connector and, more particularly, to an electrical connector having a plurality of signal terminals and a plurality of ground terminals.

BACKGROUND

Electrical connectors are used in current communication systems to transmit data. For example, a plurality of electrical connectors may be used in network systems, servers, data centers, etc., so as to interconnect a variety of devices in a communication system. Generally, an electrical connector includes an insulated housing and a plurality of conductive terminals installed in the insulated housing. The conductive terminal includes signal terminals adapted to transmit data signals and ground terminals adapted to control the impedance and reduce crosstalk between the signal terminals. In differential signal applications, two adjacent signal terminals are arranged as a pair of differential terminals to transmit a pair of differential signals. Each pair of differential terminals may be separated from the adjacent other pair of differential terminals by one or more ground terminals.

There has been a general demand to increase the density of signal terminals within electrical connectors and/or to increase the speeds at which data is transmitted through electrical connectors. However, as data rates increase and/or the distance between signal terminals decreases, maintaining a baseline level of signal integrity becomes more challenging. For example, in some cases, electrical energy propagating on the surface of each ground terminal of the electrical connector may be reflected and resonated within cavities formed between the ground terminals. In addition, some electrical connectors have a resonant cavity structure which excites the cavity resonance when the signal is transmitted, thereby contaminating the effective signal. Depending on the frequency of data transmission, electrical noise is formed, which increases return loss and/or crosstalk and reduces throughput of the electrical connector.

SUMMARY

An electrical connector includes a connector housing and a plurality of conductive terminals mounted in the connector housing. The plurality of conductive terminals include a plurality of ground terminals and a plurality of signal terminals. The ground terminals and the signal terminals are each made of a lossy metal. A surface of each of the signal terminals is coated with a low lossy metal.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
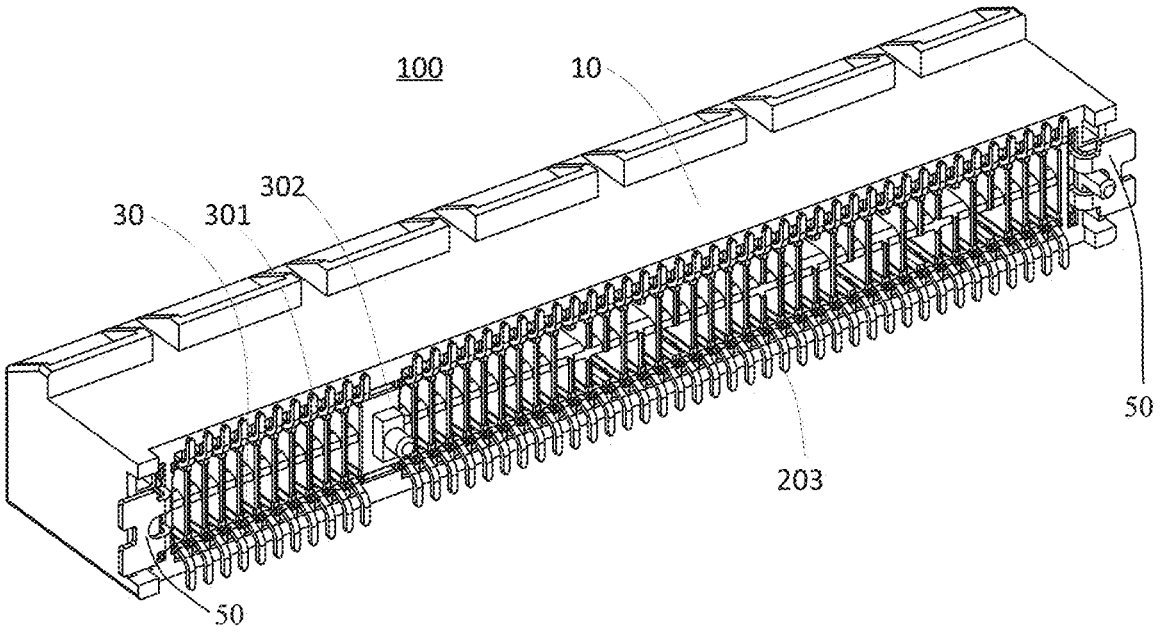
FIG. 1 is a top perspective view of an electrical connector according to an embodiment.
Figure 2:
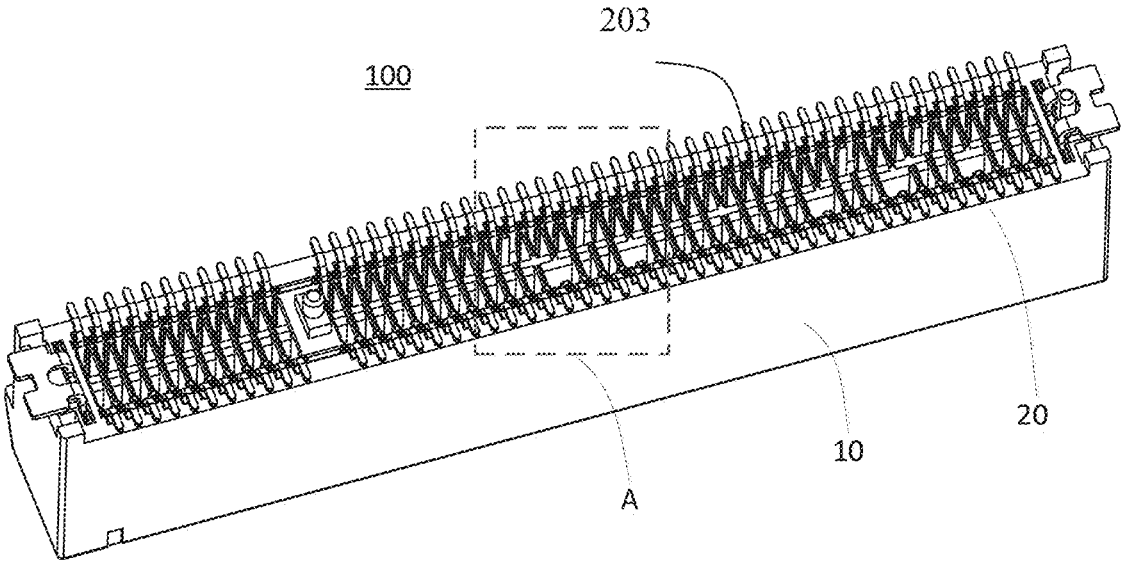
FIG. 2 is a bottom perspective view of the electrical connector.
Figure 3:
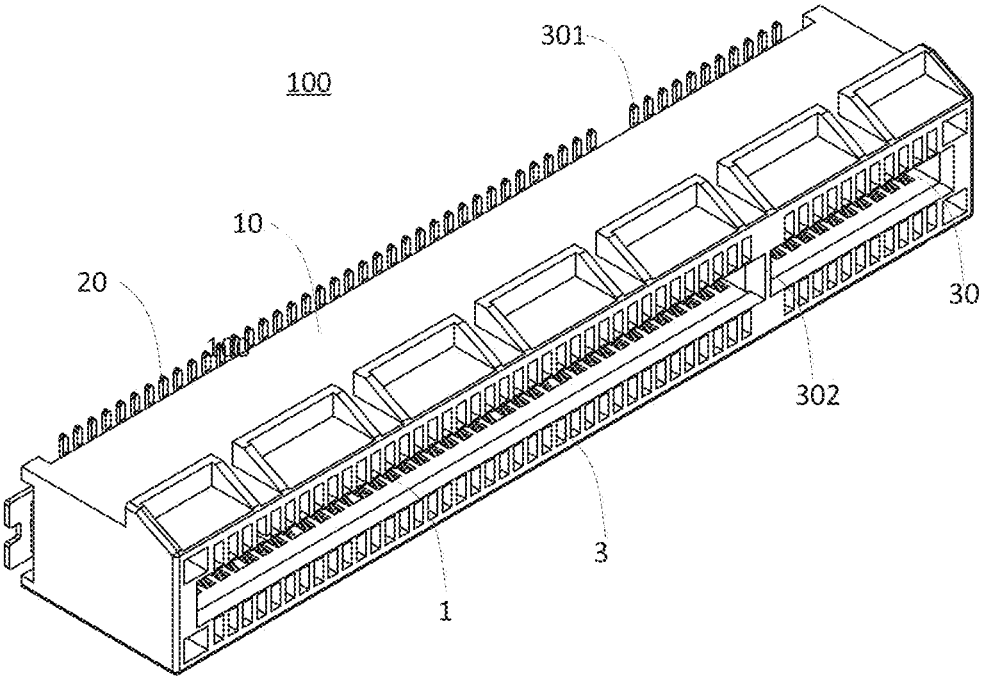
FIG. 3 is a front perspective view of the electrical connector.
Figure 4:
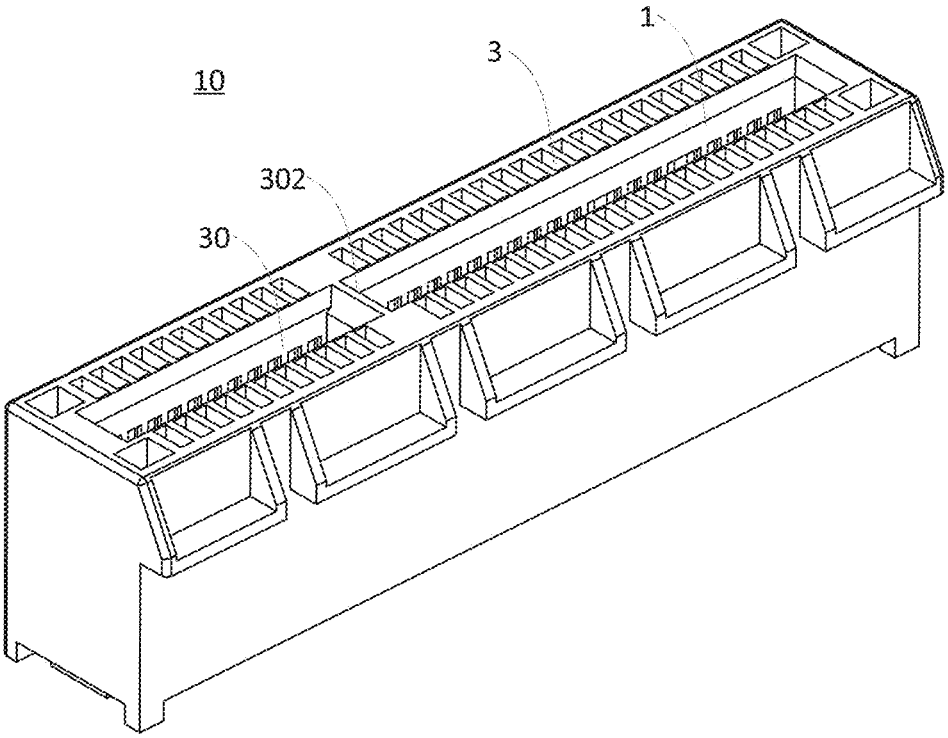
FIG. 4 is a perspective view of a connector housing.

The technical solutions of the present disclosure will be described hereinafter in detail with reference to the exemplary embodiments in conjunction with the attached drawings. In the specification, the same or similar reference numerals indicate the same or similar parts. It should be understood that the description to the embodiments of the present disclosure in conjunction with the attached drawings is to convey a general concept of the present disclosure to the person of ordinary skill in the art, and should not be construed as limiting.

Furthermore, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 10:
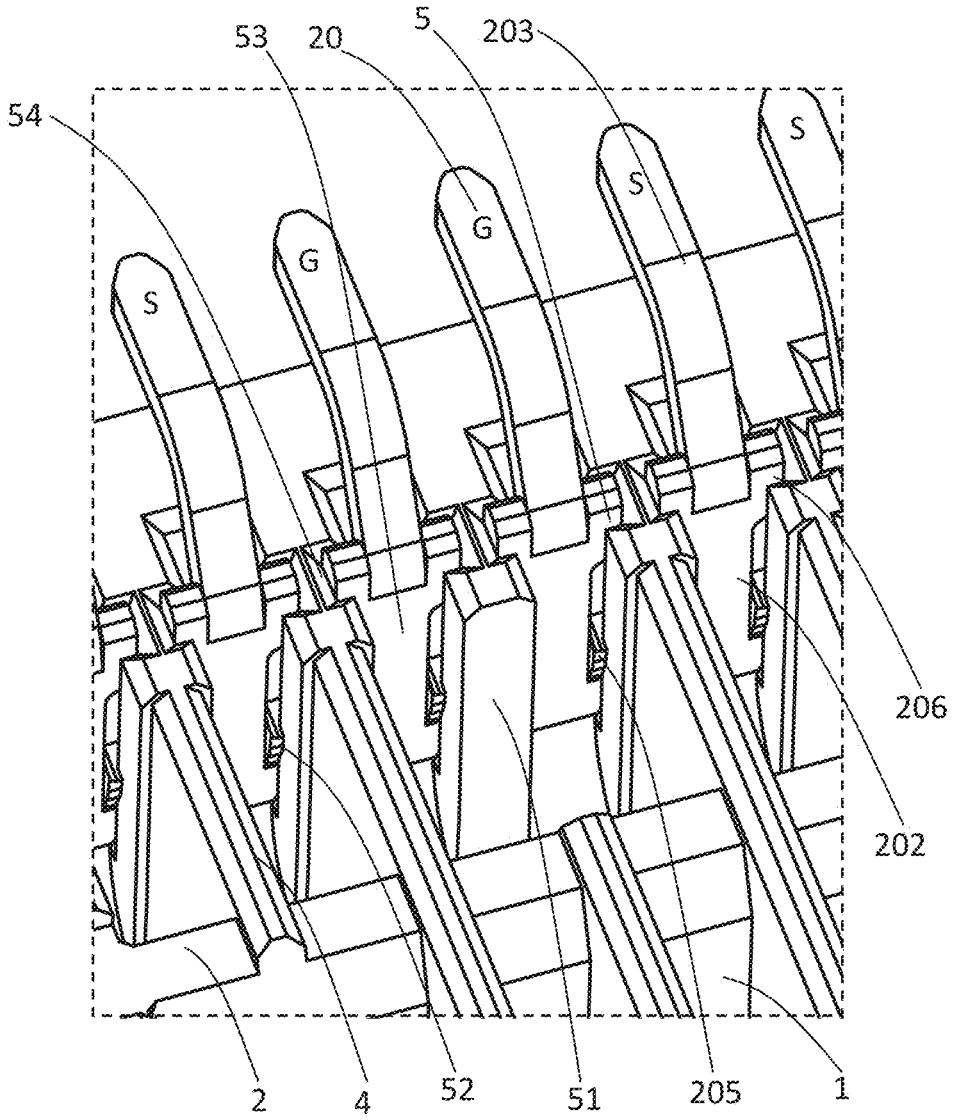
FIG. 10 is an enlarged view of a portion B of FIG. 9.
Figure 12:
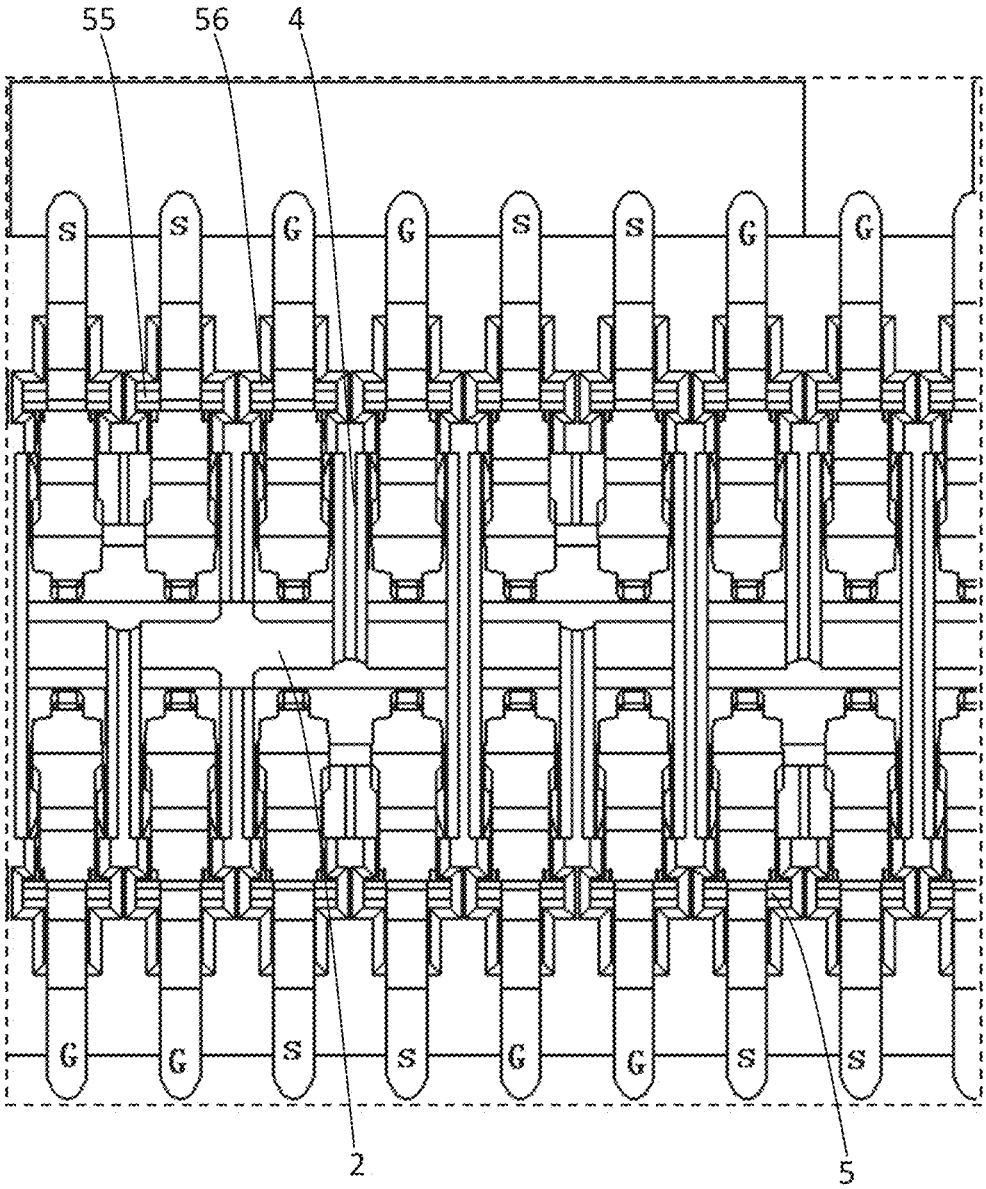
FIG. 12 is an enlarged view of the portion C according to another embodiment.

As shown in FIGS. 1-6, an electrical connector 100 according to an exemplary embodiment comprises a connector housing 10 and a pair of rows of conductive terminals 20 respectively positioned in first receiving compartments 5 of the connector housing 10, shown in FIGS. 10 and 12. A first end 204 of each conductive terminal 20 is adapted to be in electrical contact with a mating connector (not shown) that is inserted into the connector housing 10, and a second end 203 of each conductive terminal 20 is adapted to be electrically coupled to a circuit board 40, shown in FIG. 18 and described in greater detail below.

The electrical connector 100 is matable with the mating connector. In various embodiments, the mating connector may include any one of a circuit board, a circuit card, a plug connector, and the like. Signals (e.g., data and/or power signals) are transmitted between the mating connector and the circuit board 40 by the electrical connector 100. The electrical connector 100 may be used in a variety of applications that utilize ground terminals to control impedance and reduce crosstalk between signal terminals. For example, the electrical connector 100 may be used in telecommunications and computer applications, routers, servers, supercomputers, and the like. The electrical connector 100 is capable of transmitting data signals at high speeds, such as 5 Gigabits per second (Gb/s), 10 Gb/s, 20 Gb/s, 30 Gb/s, or greater. The electrical connector 100 may include a high-density array of signal terminals that are engaged mating terminals of the mating connector.

In an exemplary embodiment, as shown in FIGS. 7-10 and 15-17, the connector housing 10 is made of an insulated material, and the connector housing 10 is formed with a receiving chamber 1 (for example, a primary receiving chamber 1) therein, which extends in a longitudinal direction and runs through the connector housing 10 in a height direction. An upper portion of the receiving chamber 1 has an opening adapted to receive a portion of the mating connector. A lower middle portion of the receiving chamber 1 has a support rib 2 extending in the longitudinal direction to prevent further insertion of the mating connector.

Each of a pair of opposite side walls (upper and lower walls in FIG. 7) of the receiving chamber 1 has a row of first receiving compartments 5 facing the support rib 2, as shown in FIGS. 10 and 12. Each of the first receiving compartments 5 is adapted to position one of the conductive terminals 20 therein. An insulated wall 54 is disposed between each pair of adjacent first receiving compartments 5. A partition wall 4, which extends from an outer side of the first receiving compartment 5 in a lateral direction and is connected to the support rib 2, is provided between each pair of adjacent first receiving compartments 5. The first receiving compartment 5 includes a side wall 51 facing the support rib 2, as shown in FIG. 10.

As shown in FIG. 10, the partition wall 4 extends from a region of the side wall 51 corresponding to the insulated wall 54 to the support rib 2. A cavity extending in the height direction is defined by the first receiving compartment 5, the two adjacent partition walls 4, and the support rib 2. The cavity, for example, ensures good ventilation in the height direction inside the electrical connector 100 so as to facilitate heat dissipation. At least one of the partition walls 4 is at least partially cut away.

In an embodiment, as shown in FIGS. 5, 6, 15, and 16 each conductive terminal 20 includes a first end 204 extending to an upper portion of the receiving chamber 1, a contact portion 201 extending into the receiving chamber 1 in the lateral direction and in electrical contact with the mating connector, a fixing portion 202 fixed into the first receiving compartment 5, and a second end 203 electrically connected to a circuit board 40.

In the electrical connector 100, the cavity defined by the first receiving compartment 5, the two adjacent partition walls 4, and the support rib 2 is formed as a resonant cavity in use. Because at least one of the partition walls 4 is at least partially cut away, the occurrence of resonance may be suppressed, and the electrical properties of the electrical connector 100 are thus improved. On the other hand, the first receiving compartment 5 still maintains a hard interference with the fixing portion 202 of the conductive terminal 20, thereby firmly fixing the conductive terminal 20 in the connector housing 10.

In an exemplary embodiment, as shown in FIG. 10, a slot 53 is formed in the side wall 51 of each first receiving compartment 5 facing and near the support rib 2, and the slot 53 is formed by running through the side wall 51 of the first receiving compartment 5 and extending in the height direction.

Figure 6:
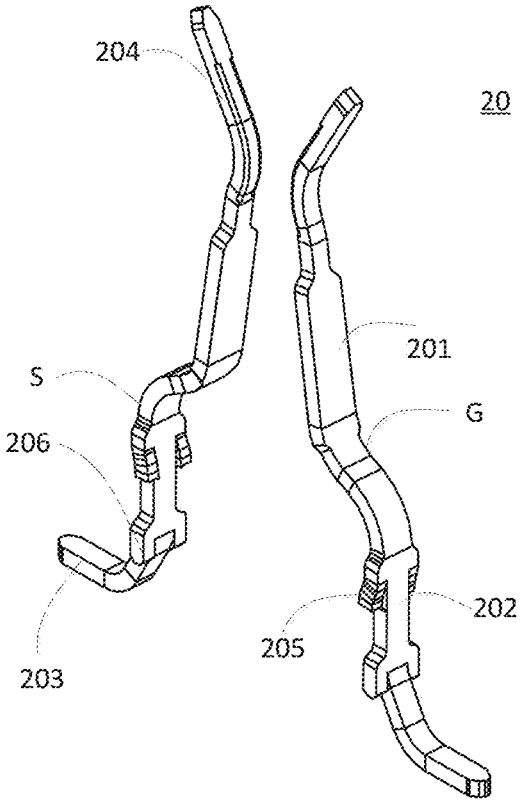
FIG. 6 is a perspective view of a pair of conductive terminals of FIG. 5.
Figure 7:
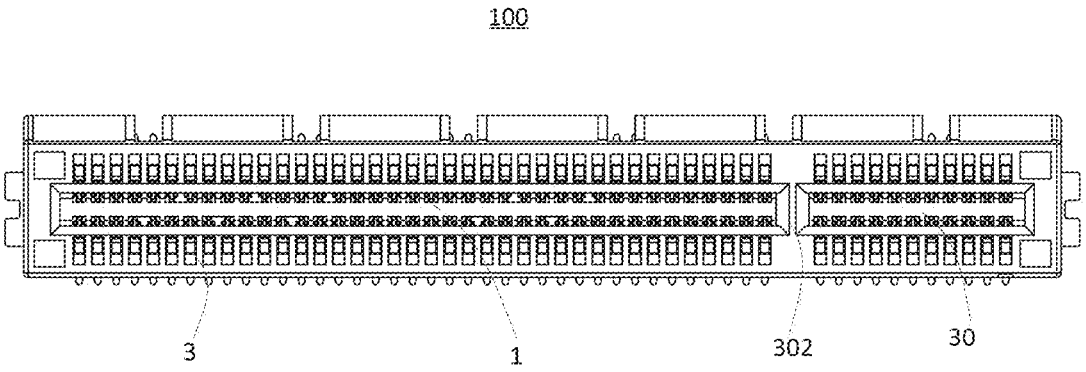
FIG. 7 is a plan view of the electrical connector of FIG. 1.
Figure 8:
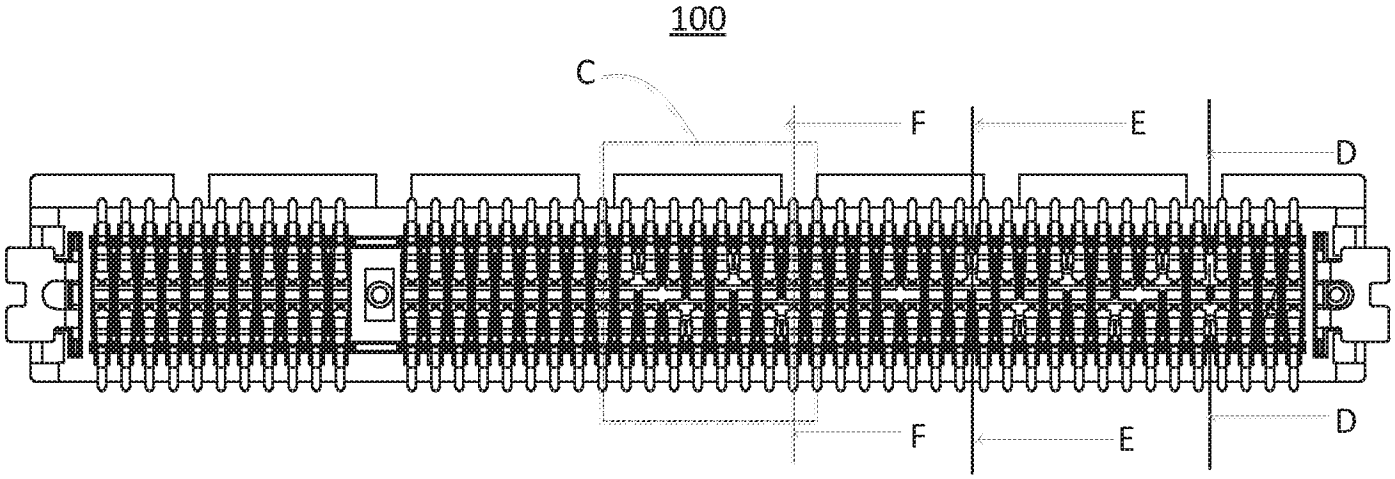
FIG. 8 is a plan view of the electrical connector of FIG. 1.
Figure 9:
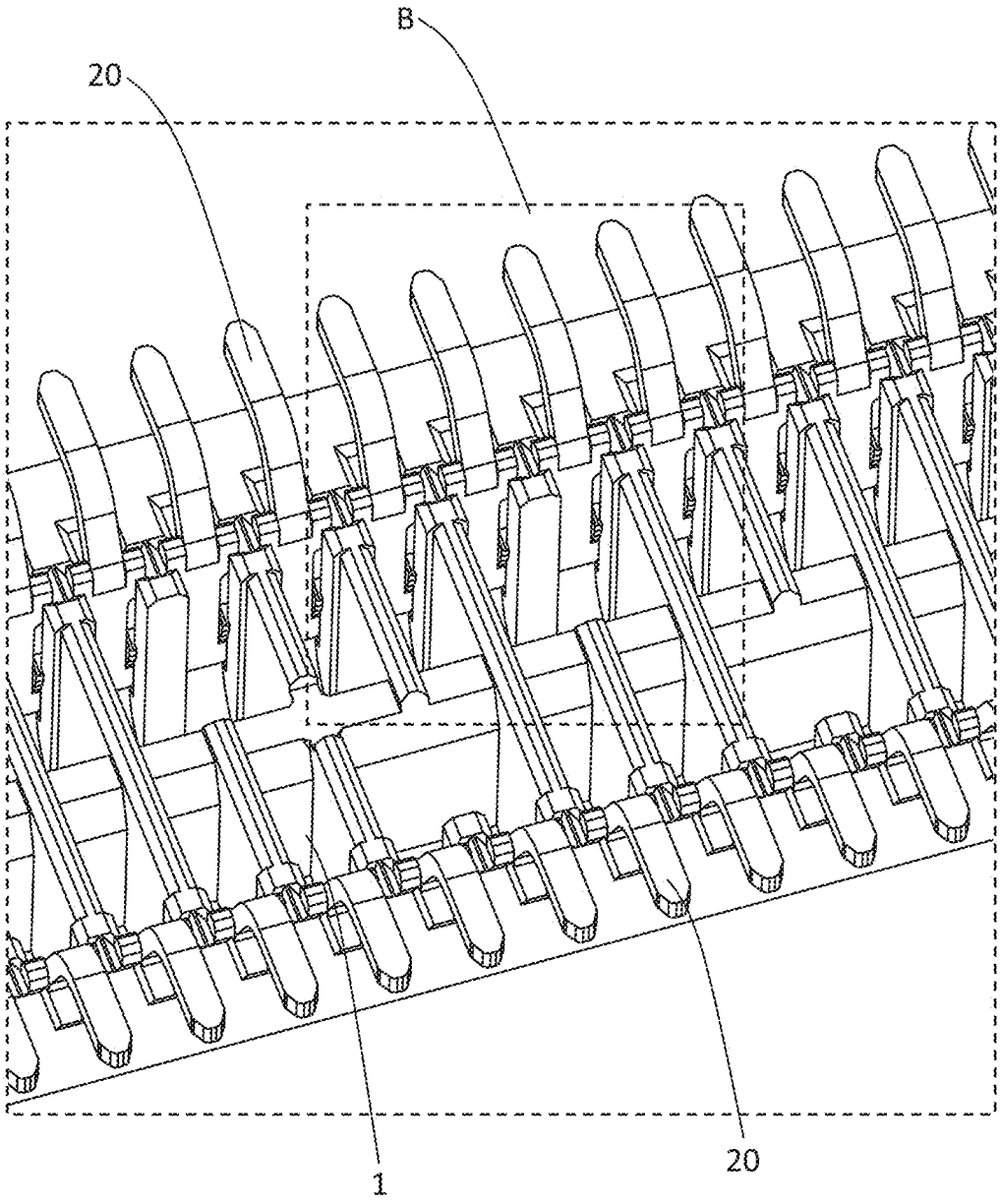
FIG. 9 is an enlarged view of a portion A of FIG. 2.

As shown in FIGS. 6 and 10, the fixing portion 202 of the conductive terminal 20 has a positioning portion 205 on a body of the fixing portion 202, and correspondingly, an inner surface of the side wall 51 of the first receiving compartment 5 has a positioning recess 52. In the case where the conductive terminal 20 is mounted in the first receiving compartment 5, the positioning portion 205 is fitted into the positioning recess 52, thereby firmly positioning the conductive terminal 20 in the first receiving compartment 5. The fixing portion 202 of the conductive terminal 20 has an engagement portion 206 adapted to be engaged with a bottom opening of the first receiving compartment 5. When the conductive terminal 20 is mounted into the first receiving compartment 5, the engagement portion 206 is engaged with the bottom opening in positive fit, as shown in FIG. 10. The above mentioned hard interference between the first receiving compartment 5 and the fixing portion 202 is thus achieved.

In an exemplary embodiment, as shown in FIGS. 3-4 and 16-17, an upper portion of each of the two opposing side walls of the receiving chamber 1 has a row of second receiving compartments 3, and upper ends of the conductive terminals 20 (the first ends 204) are adapted to slidaly enter the second receiving compartments 3 by passing through through-holes formed in the side wall of the receiving chamber 1, respectively. Because the second receiving compartment 3 may absorb the compressive deformation of the conductive terminal 20, the mating connector may be smoothly brought into contact with the contact portions 201 of the conductive terminals 20.

As shown in FIGS. 1-4, an auxiliary receiving chamber 30 extending in the longitudinal direction and the height direction is further formed in the connector housing 10. The auxiliary receiving chamber 30 is adapted to receive an auxiliary mating connector. The receiving chamber 1 and the auxiliary receiving chamber 30 are separated by an isolation structure 302. Two rows of auxiliary terminals 301 are mounted in the auxiliary receiving chamber 30. The structure of the auxiliary terminal 301 and the structure for mounting the auxiliary terminals 301 in the auxiliary receiving chamber 30 are the same as the structure of the conductive terminal 20 and the structure for mounting the conductive terminals 20 in the receiving chamber 1, respectively, and details thereof are not described herein again.

Figure 18:
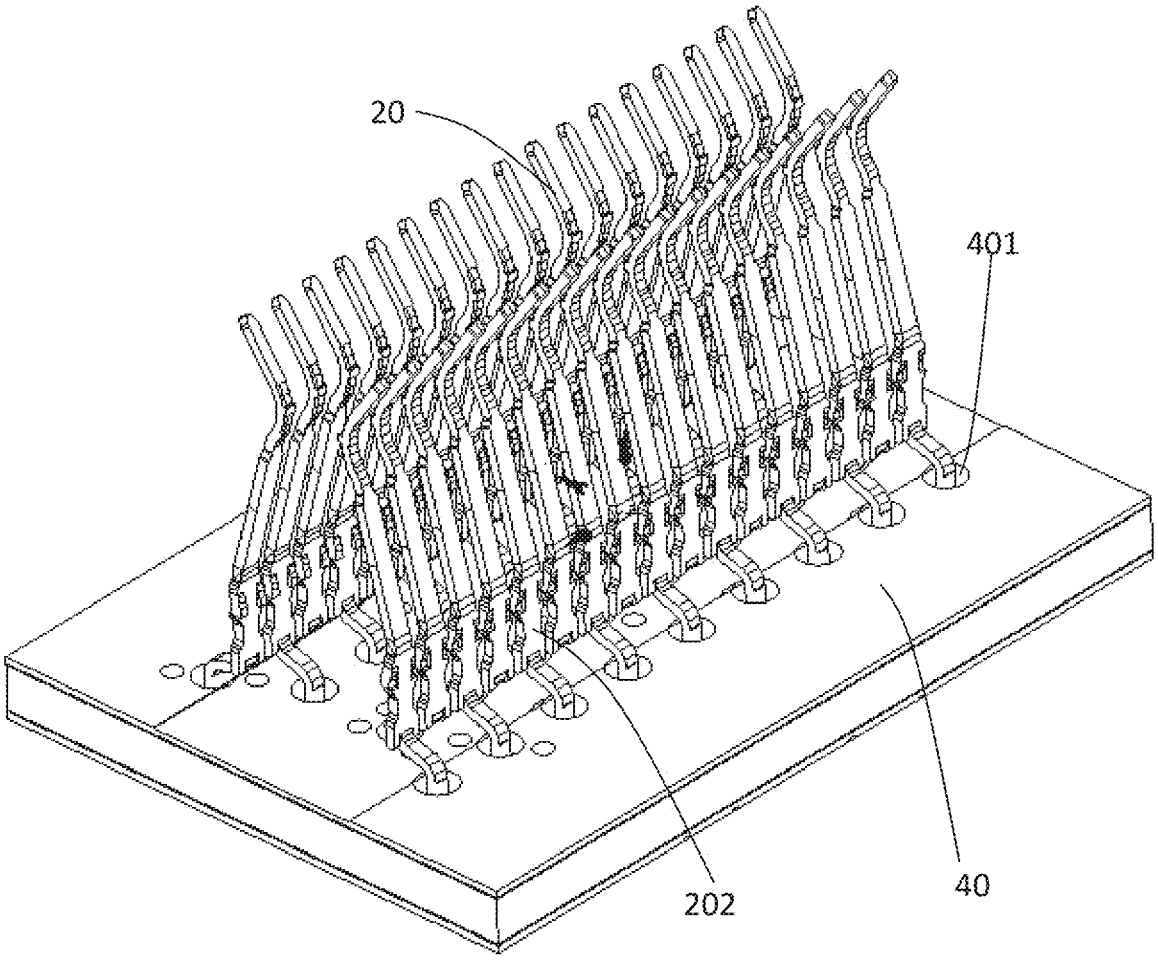
FIG. 18 is a perspective view of a conductive terminal mounted on a circuit board.

As shown in FIG. 1, two bottom ends of the connector housing 10 have mounting members 50, and the mounting members 50 are adapted to mount the connector housing 10 onto the circuit board 40. The second end 203 of the conductive terminal 20 is adapted to be electrically connected to an electrical contact of the circuit board 40 by using surface mounted technology (SMT). In an alternative embodiment, as shown in FIG. 18, a plurality of mounting holes 401 are provided in the circuit board 40, and the second ends 203 of the conductive terminals 20 are electrically connected to the circuit board 40 in plug-in manner.

In an exemplary embodiment, as shown in FIGS. 8-11, the first receiving compartments 5 include a plurality of pairs of signal receiving compartments 55 and a plurality of pairs of ground receiving compartments 56; a pair of signal receiving compartments 55 and a pair of ground receiving compartments 56 are alternately arranged. Each pair of signal receiving compartments 55 is adapted to position a pair of signal terminals S of the conductive terminals 20 therein, and each pair of ground receiving compartments 56 is adapted to position a pair of ground terminals G of the conductive terminals 20 therein. For example, each signal terminal S is disposed adjacent to the ground terminal G adapted to be mated with the signal terminal S, and two signal terminals S provided for one differential signal pair are disposed adjacent to each other without ground terminal G therebetween. Similarly, there are no signal terminals between two adjacent ground terminals G. The ground terminal G and the signal terminal S have the same structure and outer contour.

In an exemplary embodiment, as shown in FIGS. 8-11, the partition wall 4 between each pair of ground receiving compartments 56 is at least partially cut away. The partition wall 4 between each pair of signal receiving compartments 55, and the partition wall 4 between the signal receiving compartment 55 and the ground receiving compartment 56 adjacent to each other, remain.

In an exemplary embodiment, as shown in FIG. 12, the partition wall 4 between each pair of signal receiving compartments 55 is at least partially cut away. The partition wall 4 between each pair of ground receiving compartments 56, and the partition wall 4 between the signal receiving compartment 55 and the ground receiving compartment 56 adjacent to each other, remain.

Figure 13:
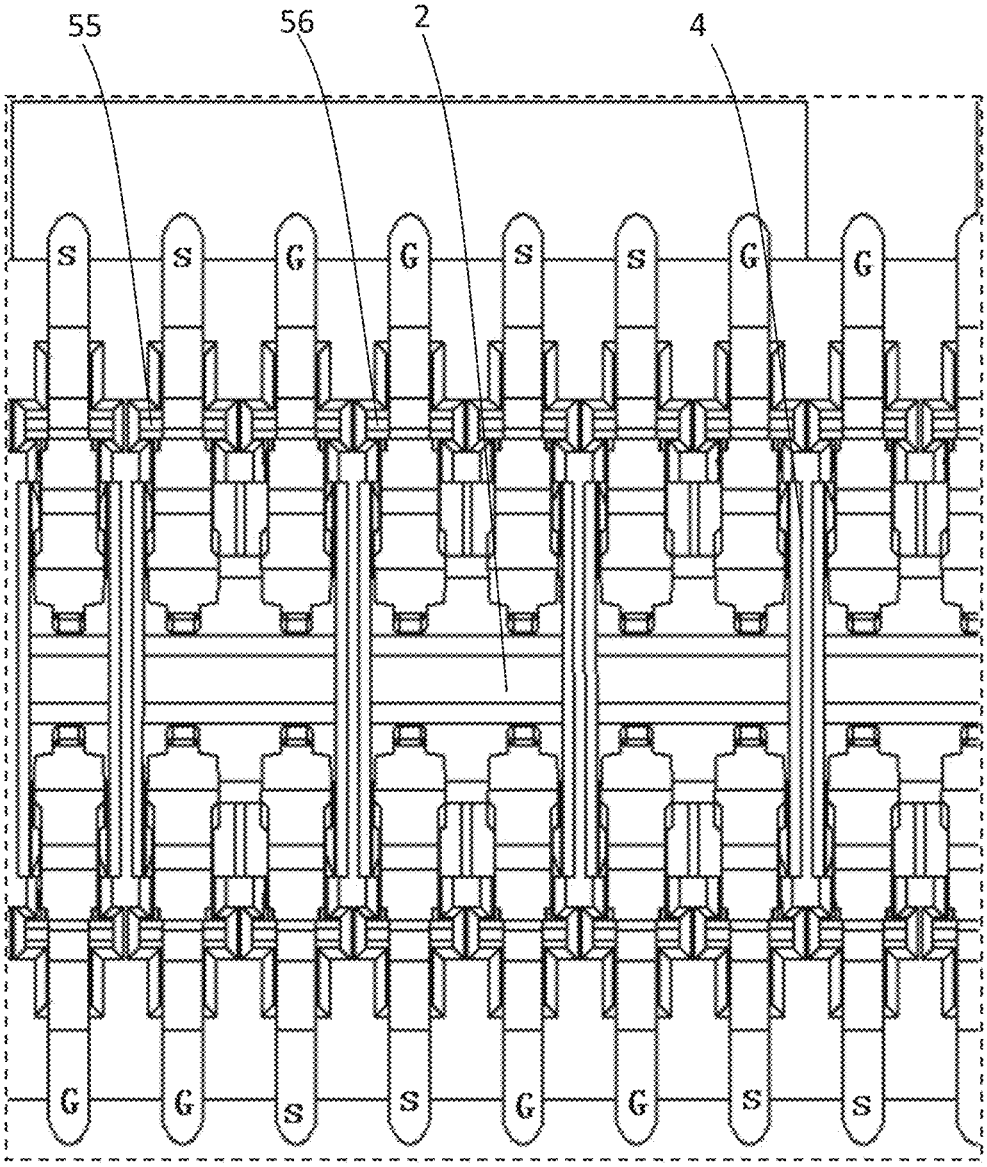
FIG. 13 is an enlarged view of the portion C according to another embodiment.

In an exemplary embodiment, as shown in FIG. 13, the partition wall 4 between the signal receiving compartment 55 and the ground receiving compartment 56 adjacent to each other is at least partially cut away. The partition wall 4 between each pair of signal receiving compartments 55, and the partition wall 4 between each pair of ground receiving compartments 56, remain.

Figure 14:
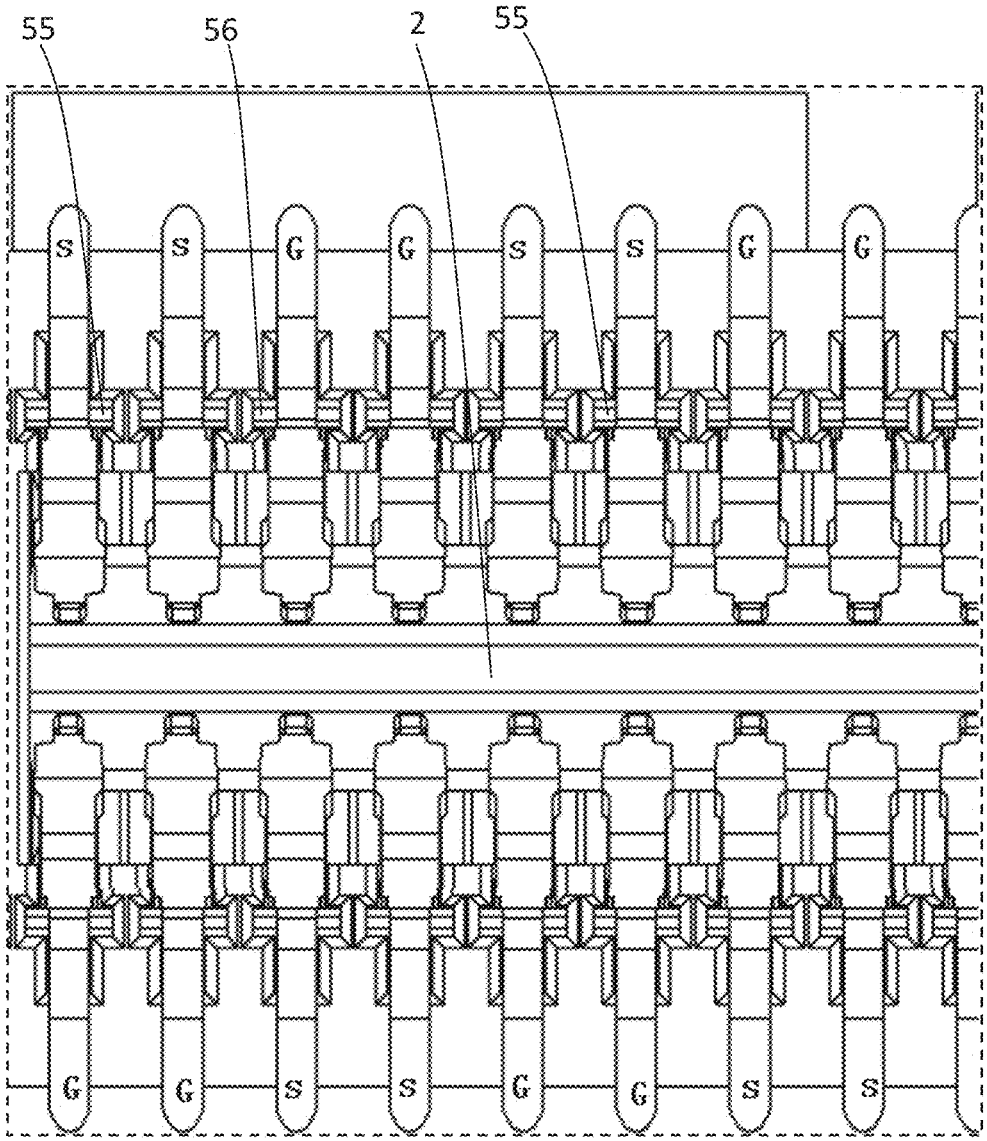
FIG. 14 is an enlarged view of the portion C according to another embodiment.
Figure 15:
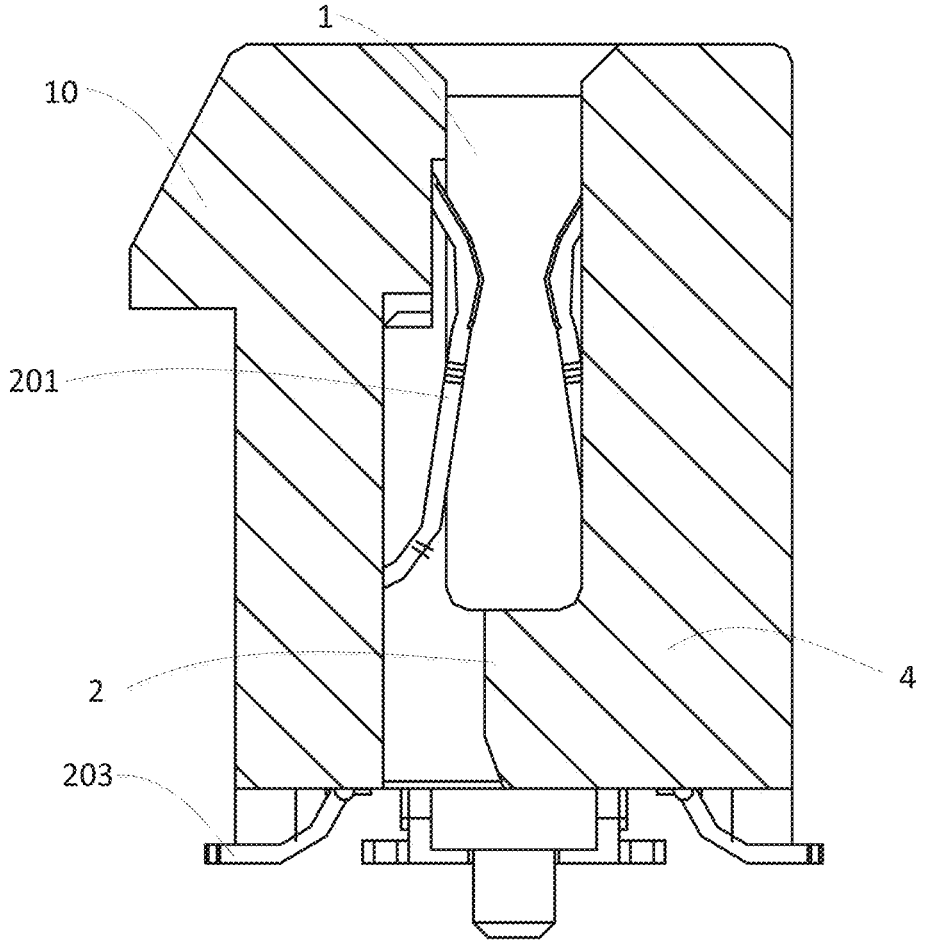
FIG. 15 is a sectional view taken along line D-D of FIG. 8.
Figure 16:
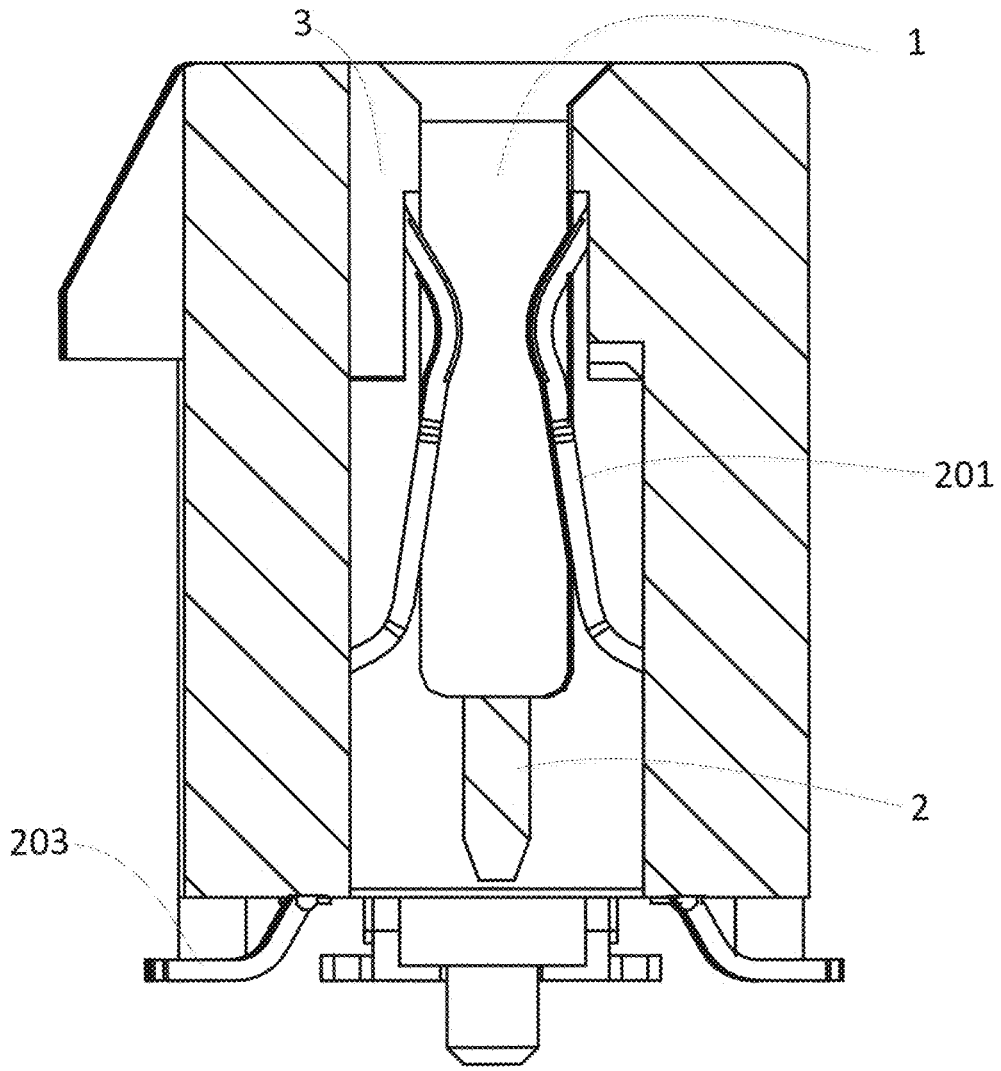
FIG. 16 is a sectional view taken along line E-E of FIG. 8.
Figure 17:
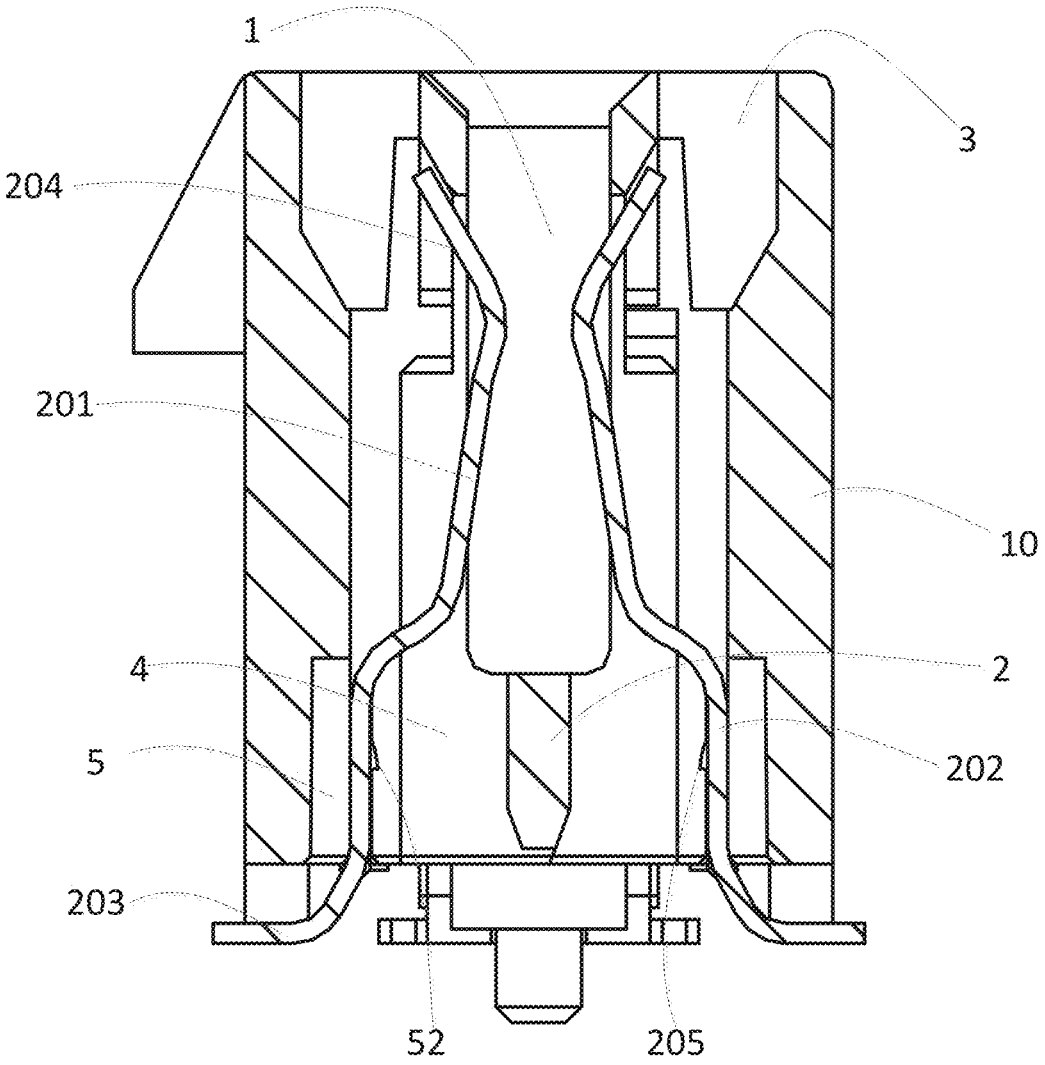
FIG. 17 is a sectional view taken along line F-F of FIG. 8.

In an exemplary embodiment, as shown in FIG. 14, each of the partition walls 4 is at least partially cut away.

In the above-described embodiments, at least partially cutting away the partition wall 4 includes: the partition wall 4 is completely removed or not present at all in the height direction, or one part of the partition wall 4 is cut away in the height direction and the other part of the partition wall 4 is still present in the height direction.

Figure 19:
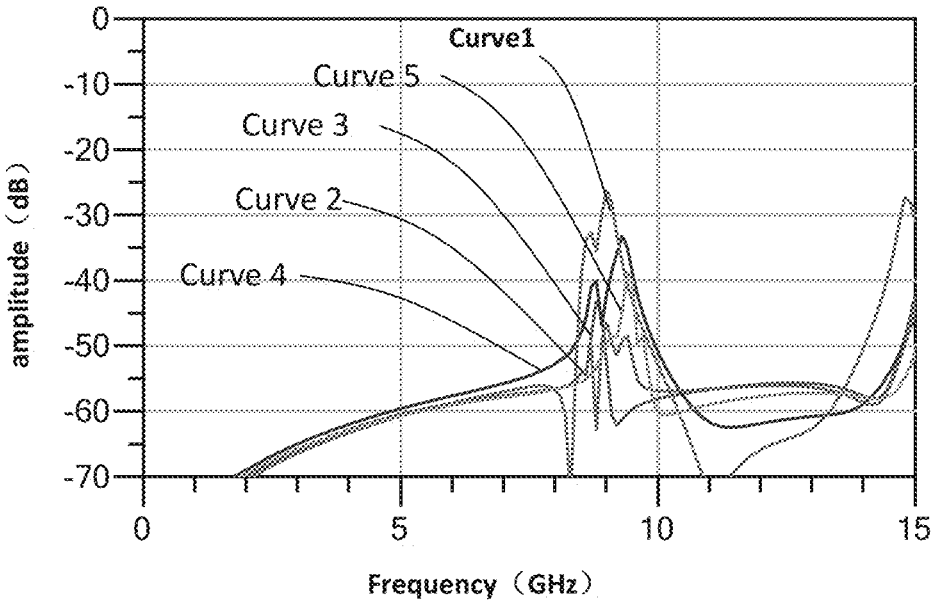
FIG. 19 is a graph of resonance peaks where the partition wall is cut way in the four manners as shown in FIGS. 11-14 and in the case where the partition wall is not cut away at all.

FIG. 19 is a graph comparing resonance peaks occurring in the case where the partition wall 4 is cut way in the four manners shown in FIGS. 11-14 and in the case where the partition wall 4 is not cut away.

Figure 11:
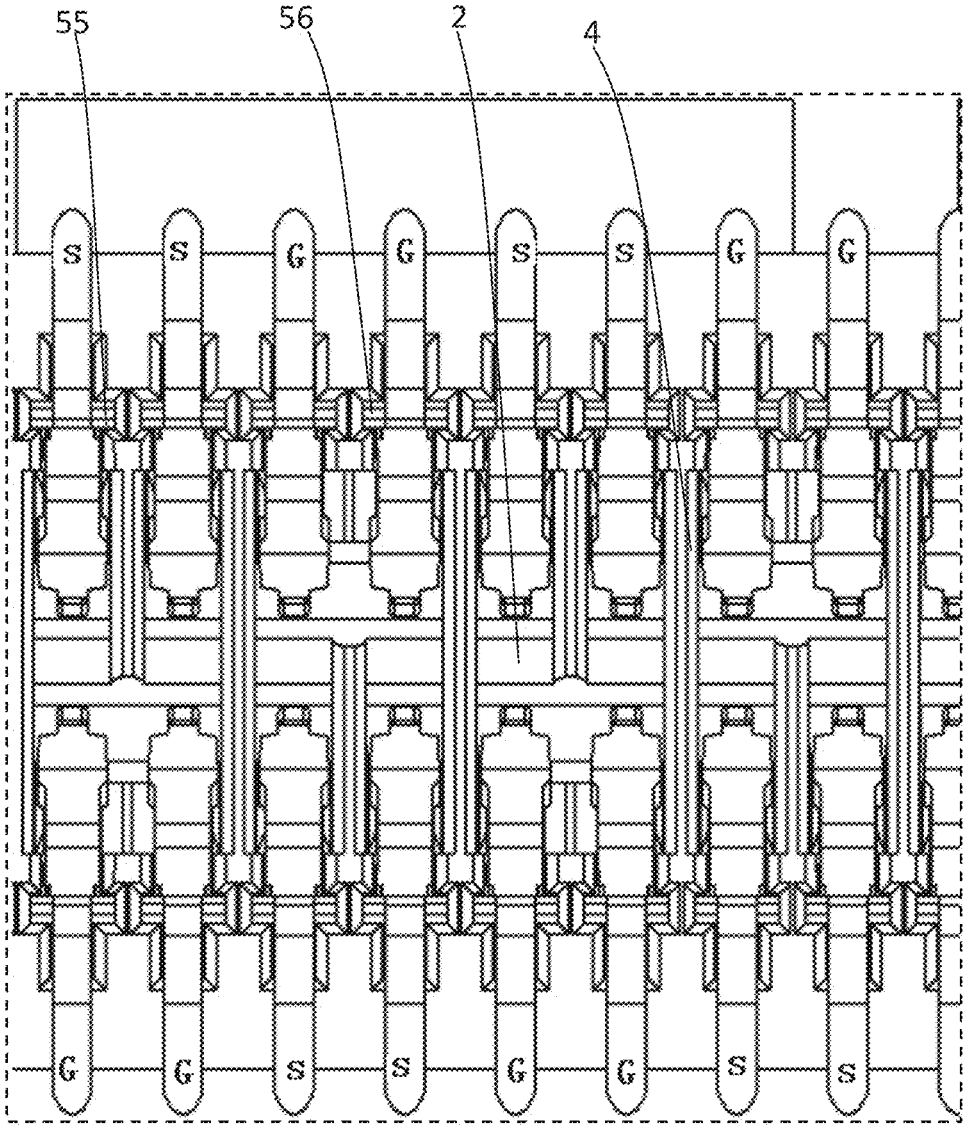
FIG. 11 is an enlarged view of a portion C of FIG. 8.

As shown in FIG. 19, a curve 1 indicates a curve of a resonance peak generated when the electrical connector 100 is operated in the case where none of the partition walls 4 of the connector housing 10 is cut away, a curve 2 indicates a curve of a resonance peak generated when the electrical connector 100 is operated in the case where the partition wall 4 of the connector housing 10 is cut away in accordance with the first embodiment as shown in FIG. 11; a curve 3 indicates a curve of a resonance peak generated when the electrical connector 100 is operated in the case where the partition wall 4 of the connector housing 10 is cut away in accordance with the second embodiment as shown in FIG. 12; a curve 4 indicates a curve of a resonance peak generated when the electrical connector 100 is operated in the case where the partition wall 4 of the connector housing 10 is cut away in accordance with the third embodiment as shown in FIG. 13; and a curve 5 indicates a curve of a resonance peak generated when the electrical connector 100 is operated in the case where the partition wall 4 of the connector housing 10 is cut away in accordance with the fourth embodiment as shown in FIG. 14.

Figure 5:
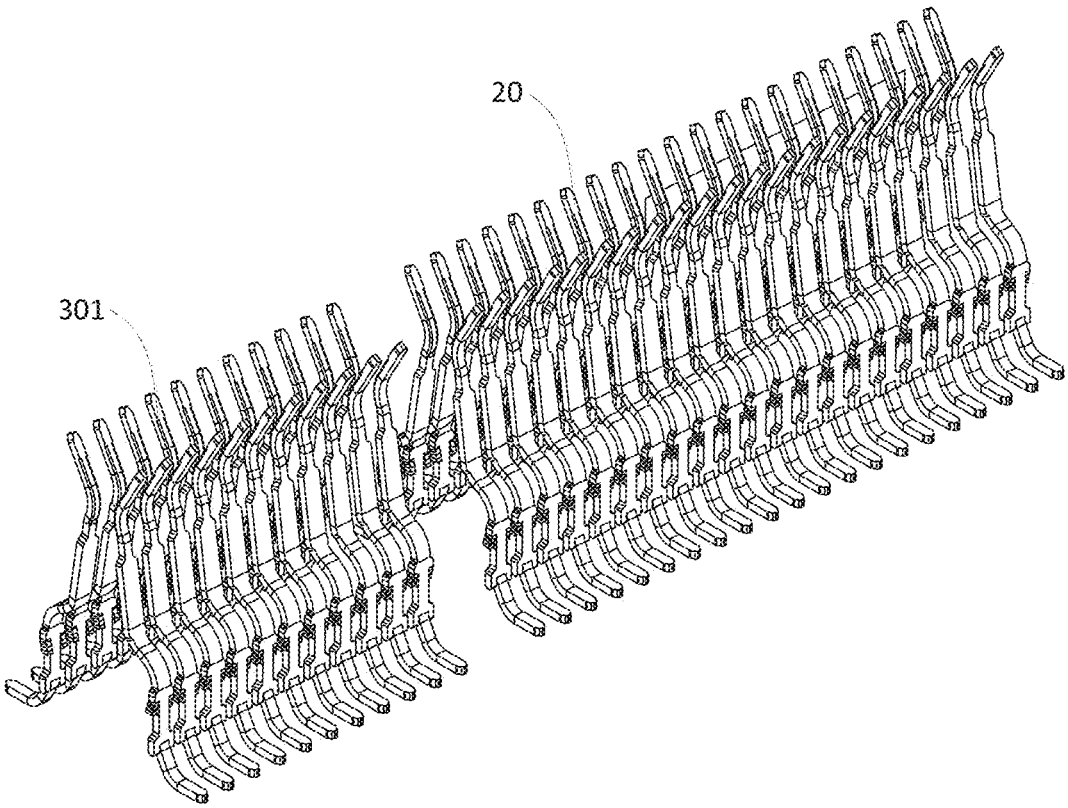
FIG. 5 is a perspective view of a pair of rows of conductive terminals.

In the electrical connector 100 according to the fifth embodiment of the present disclosure, as shown in FIGS. 5, 6, and 10, the ground terminal G and the signal terminal S in the conductive terminal 20 are both made of lossy metal, and the surface of the signal terminal S is coated with a low lossy metal by an electroplating process. Those skilled in the art understand that copper materials have good electrical conductivity but no magnetic permeability. That is to say, the copper material does not have magnetic loss.

The lossy metal is electrically conductive and magnetically permeable, but the lossy metal has poor electrical conductivity relative to the copper material over the frequency range of interest. Lossy metals include magnetically loss and/or electrically loss metals. The magnetic loss and/or electrical loss metal has a relative magnetic permeability greater than 10 or an electrical conductivity less than 1.16 $e^6$ siemens/m. The magnetic loss and/or electrical loss metal includes a stainless steel material, but embodiments of the present disclosure are not limited thereto. Magnetic loss and/or electrical loss metals may also include at least one metal material selected from a group of magnesium ferrites, nickel ferrites, lithium ferrites, yttrium garnets, and aluminum garnets. In one embodiment, the lossy metal may include a metal having both magnetic loss performance and electrical loss performance.

A metal material having large loss (such as stainless steel) is used to replace the common copper material to form the signal terminal and the ground terminal, and the resonance resulted from the structure and compact arrangement of the conductive terminals is effectively suppressed by large loss of such metal material. By coating a low lossy metal material with good conductivity such as nickel or gold on the signal terminal, the attenuation of the effective signal caused by the metal material having large loss is reduced by the skin effect of the current at a high frequency, thereby holding conductive properties of the signal terminal. Further, the conductive terminals 20 of the electrical connector 100 provided according to embodiments of the present disclosure are not affected by product tolerances and have good stability in product performance.

According to a sixth embodiment, as shown in FIGS. 5, 6, 10 and 18, the ground terminal G and the signal terminal S in the conductive terminal 20 are both made of lossy metal, and the surface of the signal terminal S is coated with a low lossy metal such as nickel and/or gold by an electroplating process. A region of the surface of the ground terminal G except for the portion (i.e. the fixing portion 202) adjacent to the second end 203 is coated with low lossy metals such as nickel and/or gold. A region of the surface of the ground terminal G except for the portion positioned in the first receiving compartment 5 is coated with low lossy metals such as nickel and/or gold. Thus, the region of the surface of the ground terminal G except for the fixing portion 202 is coated with a low lossy metal (such as nickel or gold), but the region of the surface, which is close to the circuit board 40 and where the fixing portion 202 is provided, is not coated so as to ensure that the metal having large loss is exposed to the outside. When resonance occurs, the resonance is suppressed by the large loss of the ground terminal G.

Figure 20:
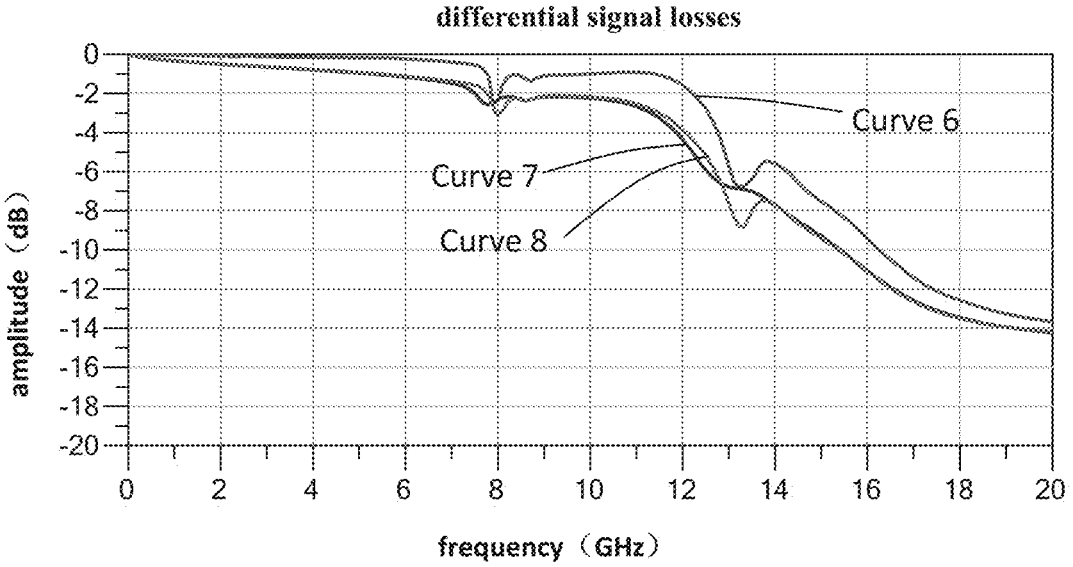
FIG. 20 is a graph showing a comparison between differential signal losses generated when an electrical connector is inserted into a mating connector.

FIG. 20 is a graph showing a comparison between differential signal losses generated when an electrical connector 100 is inserted into a mating connector, in the case where a conductive terminal 20 of the electrical connector 100 is made of lossy metal according to an embodiment of the present disclosure and in the case where a conductive terminal 20 of the electrical connector 100 is made of copper.

As shown in FIG. 20, a curve 6 indicates a differential signal loss generated when an electrical connector, the conductive terminal of which is made of copper, is inserted into a mating connector; and a curve 7 indicates a differential signal loss generated when the electrical connector 100 in accordance with the fifth embodiment is operated. A curve 8 indicates a differential signal loss generated when the electrical connector 100 in accordance with the sixth embodiment as shown in FIG. 11 is operated. As can be understood from the graph shown in FIG. 20, with the conductive terminals made of the lossy metal according to the embodiments of the present disclosure, the resonance caused by the structure and the compact arrangement of the conductive terminals 20 may be effectively suppressed.

It should be appreciated for those skilled in this art that the above embodiments are all exemplary embodiments, and many modifications may be made to the above embodiments by those skilled in this art, and various features described in different embodiments may be freely combined with each other without conflicting in configuration or principle. Although the present disclosure has been described with reference to the attached drawings, the embodiments disclosed in the attached drawings are intended to describe embodiments of the present disclosure exemplarily, but should not be construed as a limitation to the present disclosure. Although several embodiments of the general concept of the present disclosure have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector, comprising:

a connector housing having a receiving chamber extending in a longitudinal direction and a height direction, a lower portion of the receiving chamber having a support rib protruding above a floor of the receiving chamber, the support rib extending in the longitudinal direction and connected to a pair of opposite end walls of the receiving chamber, a plurality of partition walls arranged within the receiving chamber and extending between each of the pair of opposite side walls and the support rib; and a plurality of conductive terminals mounted in the connector housing and including a plurality of ground terminals and a plurality of signal terminals, the ground terminals and the signal terminals are each made of a lossy metal, a surface of each of the signal terminals is coated with a low lossy metal.

2. The electrical connector of claim 1, wherein a first end of each conductive terminal is in electrical contact with a mating connector inserted into the connector housing, and a second end of each conductive terminal is electrically connected to a circuit board.

3. The electrical connector of claim 2, wherein a region of a surface of the ground terminal except for a portion adjacent to the second end is coated with the low lossy metal.

4. The electrical connector of claim 1, wherein the lossy metal is a magnetic loss and/or an electrical loss metal.

5. The electrical connector of claim 4, wherein the magnetic loss and/or the electrical loss metal has a relative magnetic permeability greater than 10 or a conductivity less than $1.16e^6$ siemens/m.

6. The electrical connector of claim 1, wherein each of a pair of opposite side walls of the receiving chamber has a row of first receiving compartments facing the support rib and positioning the plurality of conductive terminals.

7. An electrical connector, comprising:

a connector housing having a receiving chamber extending in a longitudinal direction and a height direction, a lower portion of the receiving chamber having a support rib extending in the longitudinal direction and connected to a pair of opposite end walls of the receiving chamber, each of a pair of opposite side walls of the receiving chamber having a row of first receiving compartments facing the support rib, the receiving chamber has a partition wall disposed between each pair of adjacent first receiving compartments, the partition wall extends from an outer side of the first receiving compartments in a lateral direction and is connected to the support rib, at least one of the partition walls is at least partially cut away; and a plurality of conductive terminals mounted in the connector housing and including a plurality of ground terminals and a plurality of signal terminals, the row of first receiving compartments positioning the plurality of conductive terminals.

8. The electrical connector of claim 7, wherein the first receiving compartments include a plurality of pairs of signal receiving compartments and a plurality of pairs of ground receiving compartments, each pair of signal receiving compartments is alternately arranged with a pair of ground receiving compartments, each pair of signal receiving compartments positions a pair of signal terminals therein and each pair of ground receiving compartments positions a pair of ground terminals therein.

9. The electrical connector of claim 8, wherein the partition wall between each pair of signal receiving compartments is at least partially cut away.

10. The electrical connector of claim 8, wherein the partition wall between each pair of ground receiving compartments is at least partially cut away.

11. The electrical connector of claim 8, wherein the partition wall between the signal receiving compartment and the ground receiving compartment adjacent to each other is at least partially cut away.

12. The electrical connector of claim 8, wherein each of partition walls is at least partially cut away.

13. The electrical connector of claim 7, wherein an insulated wall is disposed between each pair of adjacent first receiving compartments.

14. The electrical connector of claim 7, wherein a slot is formed in a side wall of each first receiving compartment facing the support rib, the slot extends through the side wall of the first receiving compartment in the height direction.

15. The electrical connector of claim 14, wherein an inner surface of the side wall of the first receiving compartment has a positioning recess.

16. The electrical connector of claim 6, wherein an upper portion of each of the opposite side walls of the receiving chamber has a row of second receiving compartments.

17. The electrical connector of claim 16, wherein an upper end of each of the conductive terminals slidably enters the second receiving compartments by extending through through-holes formed in the side wall of the receiving chamber.

18. The electrical connector of claim 7, wherein the connector housing has an auxiliary receiving chamber extending in the longitudinal direction and the height direction, the auxiliary receiving chamber receiving an auxiliary mating connector, the receiving chamber and the auxiliary receiving chamber are separated by an isolation structure.

19. The electrical connector of claim 7, wherein a pair of mounting members are disposed at a pair of bottom ends of the connector housing, the mounting members mount the connector housing onto a circuit board.

20. An electrical connector, comprising:

a connector housing having a receiving chamber extending in a longitudinal direction and a height direction, each of a pair of opposite side walls of the receiving chamber has a row of first receiving compartments; and a plurality of conductive terminals mounted in the connector housing and positioned by the first receiving compartments, the terminals including a plurality of ground terminals and a plurality of signal terminals, each of the terminals including:

a first end for electrically contacting a mating connector inserted into the connector housing;

a fixing portion positioned within one of the first receiving compartments; and a second end for electrically connected to a circuit board, wherein the ground terminal is coated with a low lossy metal except in a region of the fixing portion.

* * * * *